United States Patent [19]

Hefty et al.

[11] Patent Number: 4,565,336

[45] Date of Patent: Jan. 21, 1986

[54] TAKE-UP SPOOL FOR A DEVICE FOR APPLYING AND CONVEYING A HOSE-SHAPED PROTECTIVE COVERING FOR A TOILET SEAT

[75] Inventors: Bela Hefty, Beckenried; Arpad Hefty, Richenthal Schweiz, both of Switzerland

[73] Assignee: Hygolet AG, Hergiswil, Switzerland

[21] Appl. No.: 657,325

[22] Filed: Oct. 3, 1984

[51] Int. Cl.[4] ..... B65H 16/06

[52] U.S. Cl. ..... 242/55.55; 239/52

[58] Field of Search ..... 242/55.55, 55.2, 55.3, 242/55.53, 68; 239/52, 57, 60, 327

[56] References Cited

U.S. PATENT DOCUMENTS

| | | | |
|---|---|---|---|
| 2,728,604 | 12/1955 | Garfield | 242/55.55 |
| 3,329,367 | 7/1967 | Paradiso | 242/55.55 |
| 4,497,456 | 2/1985 | Crapser | 242/55.55 |

*Primary Examiner*—John M. Jillions

*Attorney, Agent, or Firm*—Irvin A. Lavine

[57] ABSTRACT

In the take-up spool of a device for applying and conveying a hose-shaped protective covering for a toilet seat, a cavity is provided into which disc-shaped tablets can be inserted for deodorization and/or disinfection. The cavity has stops for securing the tablets' position and openings for discharging the agents given off by the tablets to the air.

2 Claims, 2 Drawing Figures

Figure 1:
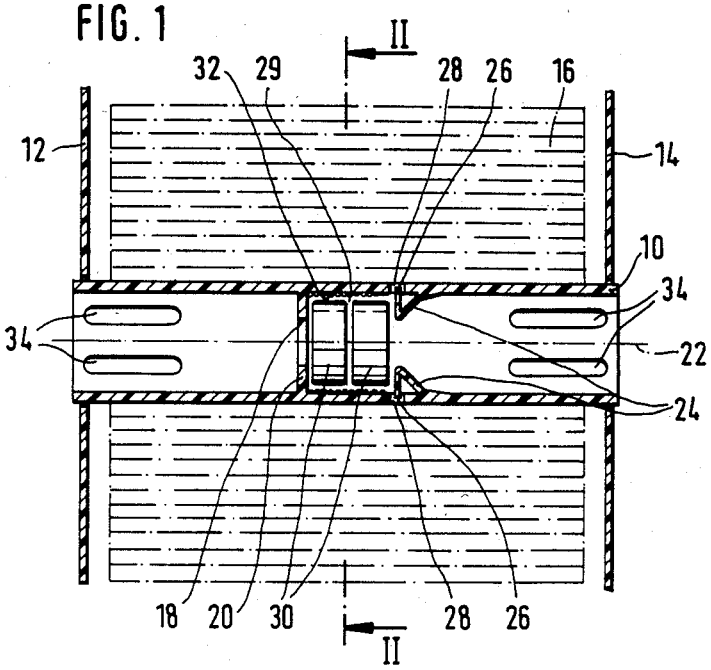

TAKE-UP SPOOL FOR A DEVICE FOR APPLYING AND CONVEYING A HOSE-SHAPED PROTECTIVE COVERING FOR A TOILET SEAT

The invention relates to a take-up spool for a device for applying and conveying a hose-shaped protective covering for a toilet seat, whereby the protective covering is drawn off from an unwinding spool and rolled up onto a motor-driven take-up spool after use and whereby the unwinding spool and the take-up spool are arranged in a common housing which is to be fastened to the toilet seat.

A device of this type is known from German Pat. No. 28 35 257. It became apparent with use of this known device that a deodorization and/or disinfection is desirable with the covering which is rolled up onto the take-up spool after use.

It is therefore the object of the invention to provide, in the area of the take-up spool, an effective deodorization and/or disinfection which, on the one hand, work reliably and, on the other hand, can be realized at low cost with respect to manufacture and use.

This object is accomplished, according to the invention, with a take-up spool of the above-mentioned type in which the take-up spool comprises a cavity into which disc-shaped tablets can be inserted which give off deodorizing and/or disinfecting agents to the surrounding air. The tablets can comprise substances which are known in themselves for the noted purposes and can be very easily inserted into the cavity provided therefor and, if necessary, replaced. They develop maximum effectiveness at this point, since the used protective covering is rolled up onto the take-up spool and thus comes directly under the influence of the agents given off by the tablets. The arrangement of the tablets inside the take-up spool is, moreover, also very advantageous because, in this otherwise unused location, they do not require any additional place in the housing, which should be made as small as possible.

In a practical embodiment of the invention, the cavity has stops for determining the position of the tablets.

With a preferred embodiment, the take-up spool is a tube in whose middle area a stop wall, provided with at least one opening, is provided for the tablets, and counter-stops are formed by elastic tongues which protrude inwardly from the inner wall of the tube. The tablets can be inserted into the cavity between the tongues and are secured by them in their position in the cavity. For practical purposes, the disc-shaped tablets have a diameter which is a little smaller than the inside diameter of the tube, so that they can be inserted into the cavity coaxially to the longitudinal axis of the tube from its ends. The agents given off by the tablets can then pass out through the ends of the tube and through suitable openings thereof. For this purpose, slots, which project axially beyond the rolled-up protective covering, are preferably provided at the ends of the tube.

Generally, one tablet each for deodorization and for disinfection are simultaneously inserted into the cavity. The tablets are usually provided with a protective casing which must either be removed prior to insertion or else is automatically removed by abrasion on the inner wall of the tube. For this purpose, in a further embodiment of the invention, the inner wall of the tube is provided, in the area of the cavity, with roughenings which facilitate the automatic removal of the protective casing.

Figure 2:
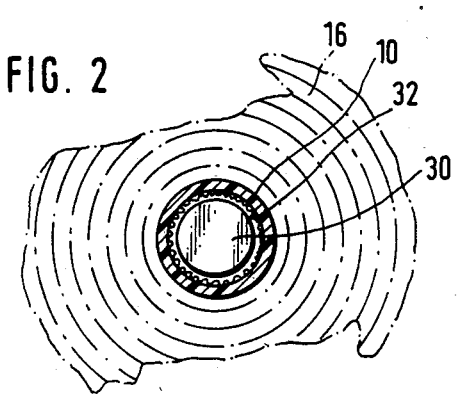

A preferred embodiment of the invention is illustrated in greater detail with reference to the drawings, showing:

FIG. 1 a partly schematic axial section through the take-up spool with rolled-up protective covering and FIG. 2 a partial cross-section taken along the line II—II in FIG. 1.

The take-up spool 10 is shaped like a tube which is notatable in two parallel walls 12 and 14 of the housing, which is otherwise not shown. The motor drive of take-up spool 10 is also not shown since it does not form part of the invention. In the illustrated example, a large quantity of the used hose-shaped protective covering 16 is already rolled up onto the take-up spool 10.

In the middle area of the tubular take-up spool 10, a stop wall 20 is provided, which has an opening 18 and which is arranged at right angles to the longitudinal axis 22 of the take-up spool 10. As counter-stops, elastic tongues 24 are provided which protrude inwardly in one piece from the inner wall of the take-up spool 10, the ends 26 of said tongues, which are bent outward at right angles, project into openings 28 of the take-up spool 10 which are provided therefor. Two disc-shaped tablets 30, which are arranged coaxially to the longitudinal axis 22, are inserted into the cavity 29 between stop wall 20 and elastic tongues 24; these tablets have been inserted into the cavity 29 between the two elastic tongues 24 and are now held by them in their position in the cavity 29 formed by take-up spool 10, stop wall 20 and elastic tongues 24. Preferably, one of the tablets 30 gives off a deodorizing agent and the other a disinfecting agent to the surrounding air. The inner wall of the take-up spool 10 is provided with roughenings 32 in the area of the cavity 29 for automatic removal of a protective casing, which is not shown, of the two tablets.

In order that the agent given off by the tablets 30 can pass out in a controlled manner in the outer area of the rolled-up protective covering 16, elongated slots 34 are provided near the ends of the take-up spool 10; these slots protrude in the axial direction beyond the lateral edges of the protective covering 16.

We claim:

1. A take-up spool for a protective covering for a toilet seat, said take-up spool being tubular and having a cavity into which disc-shaped tablets can be inserted which give off deodorizing and/or disinfecting agents to the surrounding air, a stop wall in the middle portion of the cavity, at least one elastic tongue protruding from the inner wall of the tubular spool spaced from the stop wall and defining thereby a tablet stopping position, said tongue being movable by a tablet during insertion thereof to a non-stopping position for passage of a tablet into the space between said stop wall and a said elastic tongue, and means defining a passage for enabling gas to pass from said cavity.

2. The take-up spool of claim 1, wherein the interior surface of the cavity of the tubular spool is roughened.

* * * * *